US008919879B1

(12) United States Patent
Rice Golin

(10) Patent No.: US 8,919,879 B1
(45) Date of Patent: Dec. 30, 2014

(54) CONVERTIBLE SEAT COVER

(71) Applicant: Melissa Rice Golin, Palmeto Bay, FL (US)

(72) Inventor: Melissa Rice Golin, Palmeto Bay, FL (US)

( * ) Notice: Subject to any disclaimer, the term of this patent is extended or adjusted under 35 U.S.C. 154(b) by 69 days.

(21) Appl. No.: 13/758,319

(22) Filed: Feb. 4, 2013

Related U.S. Application Data

(60) Provisional application No. 61/601,223, filed on Feb. 21, 2012.

(51) Int. Cl.
*A47C 31/00* (2006.01)
*A45F 4/02* (2006.01)

(52) U.S. Cl.
CPC ..... *A45F 4/02* (2013.01)
USPC ..... 297/228.1; 297/224

(58) Field of Classification Search
CPC ..... A47C 7/66; A45F 4/02; A45F 3/04; A45F 3/047; B65D 33/28
USPC ..... 297/219.1, 223, 224, 228.1
See application file for complete search history.

(56) References Cited

U.S. PATENT DOCUMENTS

| | | | | |
|---|---|---|---|---|
| D584,894 | S * | 1/2009 | McDaniel | D3/244 |
| 8,342,750 | B2 * | 1/2013 | Heinlen et al. | 383/2 |
| 8,491,976 | B2 * | 7/2013 | Sato et al. | 428/34.1 |
| 2004/0179756 | A1 * | 9/2004 | Kani | 383/72 |
| 2009/0026159 | A1 * | 1/2009 | Mazur et al. | 211/85.8 |
| 2010/0284631 | A1 * | 11/2010 | Lee | 383/12 |

* cited by examiner

*Primary Examiner* — Sarah B McPartlin
(74) *Attorney, Agent, or Firm* — Albert Bordas, P.A.

(57) ABSTRACT

A stadium-styled universal seat cover that converts to a backpack or tote having a front wall with first and second lateral edges, and first and second edges. The front wall also has first stitching adjacent to the first edge. The front wall further has first and second slits. A rear wall extends from the second edge. The rear wall has third and fourth lateral edges, and a third edge. The rear wall further has second stitching adjacent to the third edge. An engaging wall also extends from the second edge. The engaging wall has fifth and sixth lateral edges, and a fourth edge. The engaging wall further has third stitching adjacent to the fourth edge. The stadium-styled universal seat cover that converts to a backpack or tote also has a cord assembly.

20 Claims, 5 Drawing Sheets

CONVERTIBLE SEAT COVER

OTHER RELATED APPLICATIONS

The present non-provisional patent application is filed under 35 U.S.C. 119(e) and claims the benefit of Provisional Application No. 61/601,223, filed on Feb. 21, 2012, which is hereby incorporated by reference.

BACKGROUND OF THE INVENTION

1. Field of the Invention

The present invention relates to seat covers, and more particularly, to seat covers that convert to backpacks or totes.

2. Description of the Related Art

Applicant is not aware of any universal seat covers that convert to backpacks or totes.

SUMMARY OF THE INVENTION

The instant invention is a stadium-styled universal seat cover that converts to a backpack or tote. More specifically, the instant invention is a convertible seat cover comprising a front wall having first and second lateral edges, and first and second edges. The front wall also comprises first stitching adjacent to the first edge. The front wall further comprises first and second channels.

A rear wall extends from the second edge. The rear wall comprises third and fourth lateral edges, and a third edge. The rear wall further comprises second stitching adjacent to the third edge.

An engaging wall also extends from the second edge. The engaging wall comprises fifth and sixth lateral edges, and a fourth edge. The engaging wall further comprises third stitching adjacent to the fourth edge.

The instant invention also comprises a cord assembly.

The engaging wall comprises an attachment point located at a predetermined distance from the fourth edge. The rear wall comprises a first grommet. A cord extends from the attachment point to a first grommet. The engaging wall comprises an expandable section. The front and rear walls and/or the engaging wall comprise a window that is transparent; and may comprise a matrix barcode. The first and second channels extend between the first edge and the first stitching. The front wall and the rear wall have a similar shape and dimension. The engaging wall extends from the second edge a predetermined distance towards the third edge. The rear wall further comprises third and fourth channels. The third and fourth channels extend between the third edge and the second stitching.

The convertible seat cover further comprises second and third grommets located at a predetermined distance from the second edge. The cord assembly comprises two cords. The two cords each have first and second ends. The first ends are secured to the second grommet. The second ends enter through the first and third channels. The second ends exit through the second and fourth channels and are secured at the third grommet. The cord assembly is secured between the first edge and the first stitching at the front wall, and between the third edge and the second stitching at the rear wall.

It is therefore one of the main objects of the present invention to provide a stadium-styled universal seat cover that converts to a backpack or tote having advertising thereon.

It is another object of the present invention to provide a stadium-styled universal seat cover that converts to a backpack or tote that fits seats with or without armrests.

It is another object of the present invention to provide a stadium-styled universal seat cover that converts to a backpack or tote that is volumetrically efficient for carrying, transporting, and storage.

It is another object of the present invention to provide a stadium-styled universal seat cover that converts to a backpack or tote without the need of any special tools.

It is another object of the present invention to provide a stadium-styled universal seat cover that converts to a backpack or tote that is of a durable and reliable construction.

It is yet another object of this invention to provide such a seat cover that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
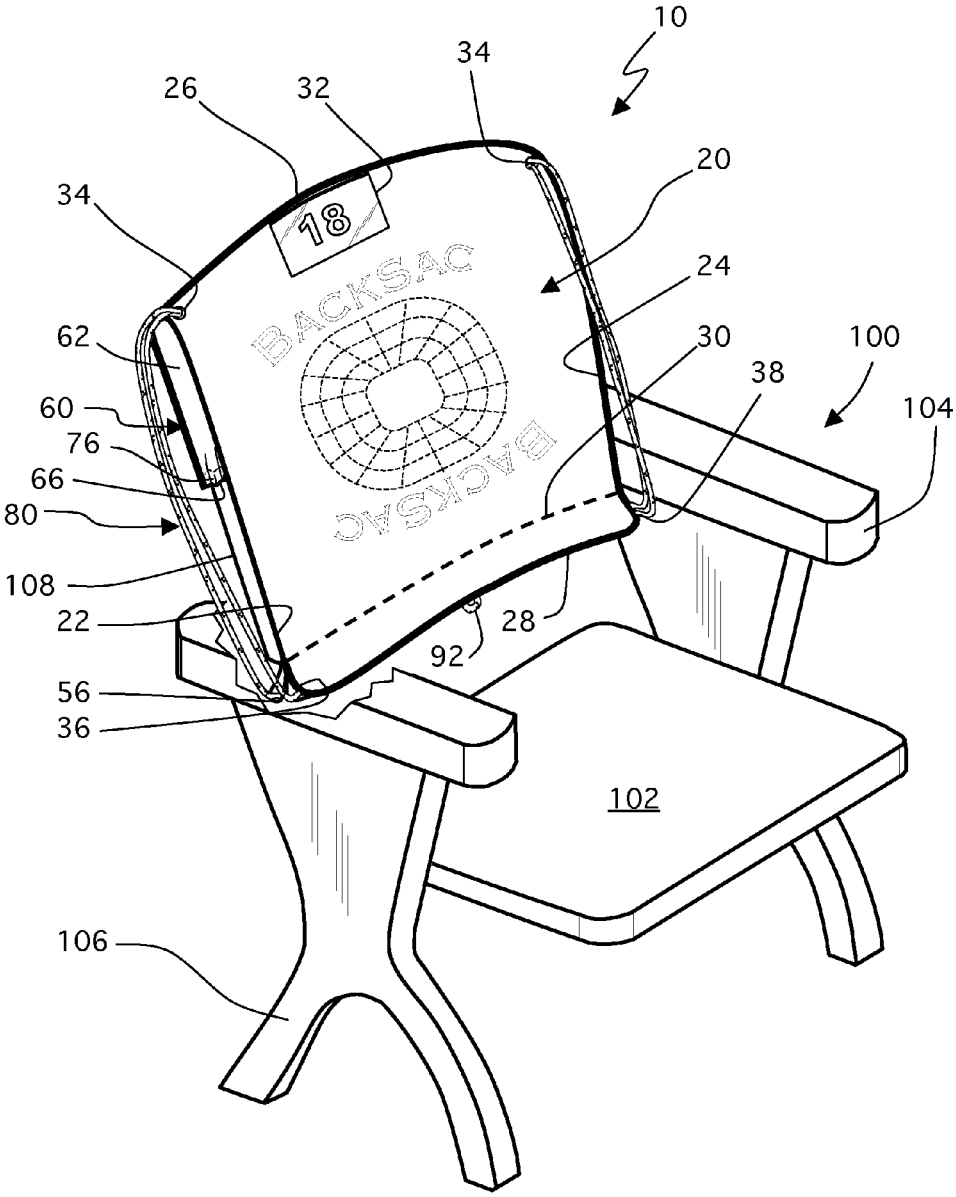
FIG. 1 is a front isometric view of a convertible seat cover in a seat cover configuration mounted upon a seat.

Referring now to the drawings, the present invention is a stadium-styled universal seat cover that converts to a backpack or tote, and is generally referred to with numeral 10. It can be observed that it basically includes front wall 20, rear wall 40, and engaging wall 60.

As seen in FIG. 1, front wall 20 comprises lateral edges 22 and 24, and edges 26 and 28. Front wall 20 also comprises stitching 30 adjacent to edge 28. Grommets 34 are located at a predetermined distance from edge 26, preferably adjacent to lateral edges 22 and 24. In addition, front wall 20 comprises open channels 36 and 38.

Figure 2:
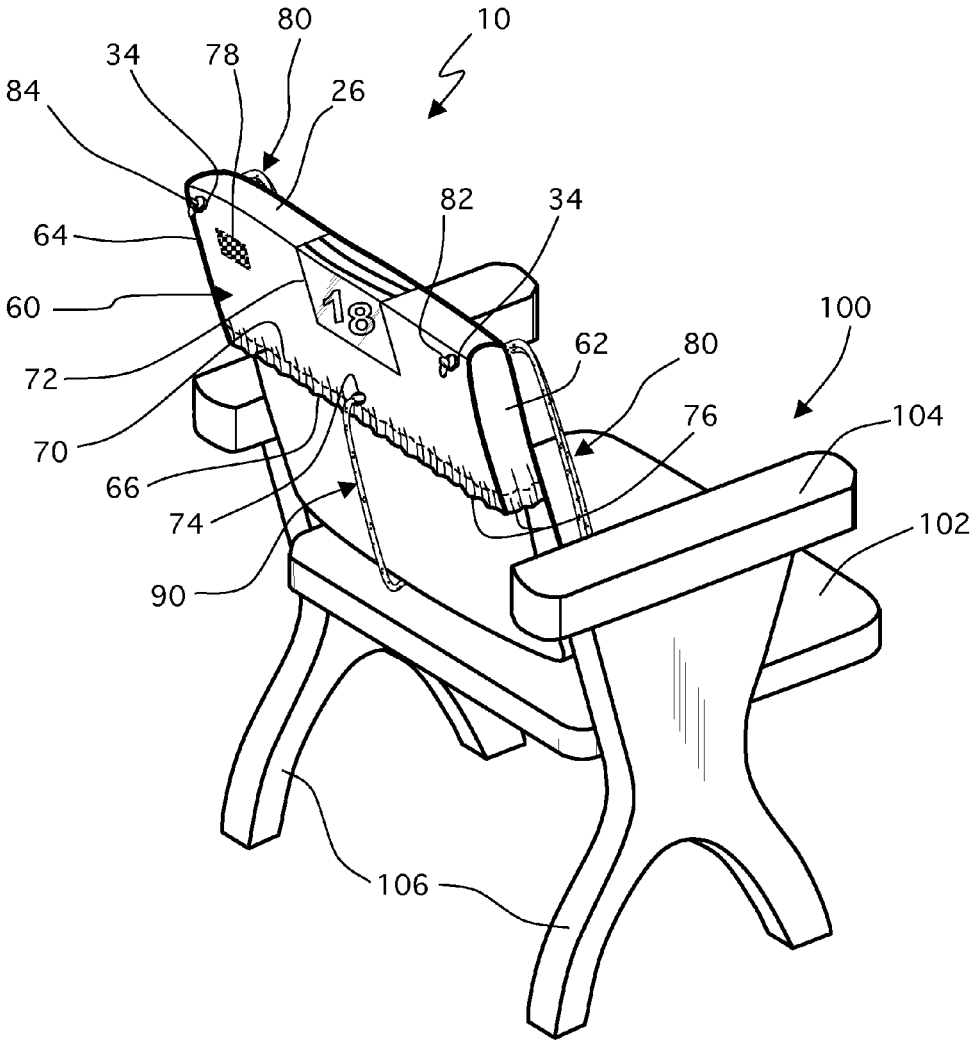
FIG. 2 is a rear isometric view of the convertible seat cover in the seat cover configuration mounted upon the seat seen in FIG. 1.

As seen in FIGS. 1 and 2, seat assembly 100 comprises seat 102, armrests 104, legs 106, and backrest 108. In some cases, backrest 108 may have a seat number or identification data thereon. In the illustrated example, backrest 108 has seat number "18". Front wall 20 comprises window 32, which is transparent, so that the seat number is visible.

Figure 3:
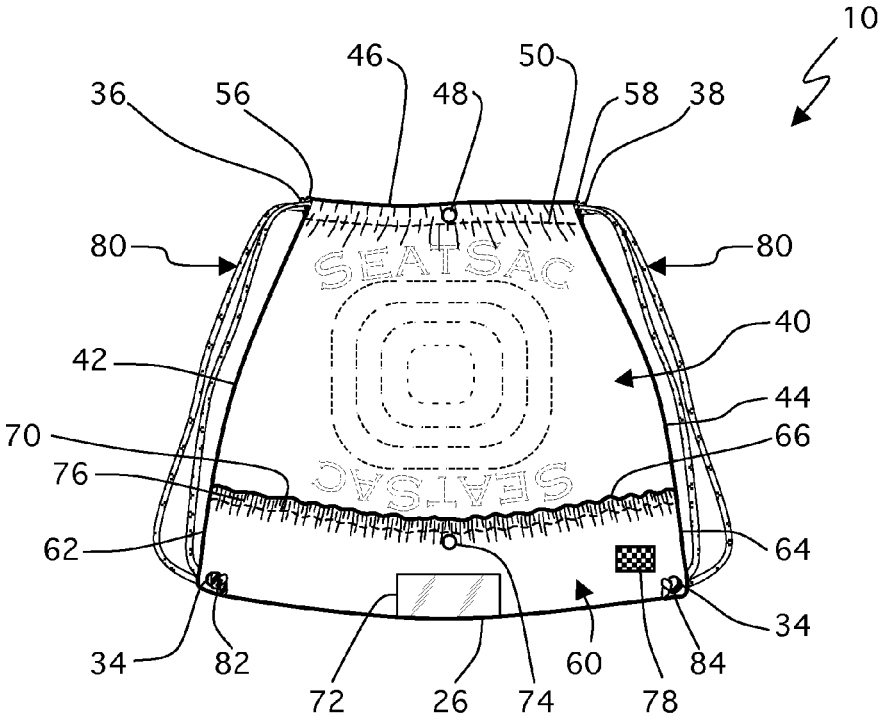
FIG. 3 is a front elevational view of the convertible seat cover in a backpack configuration.

As seen in FIG. 2, engaging wall 60 extends from edge 26 a predetermined distance towards edge 46 seen in FIG. 3. Engaging wall 60 comprises lateral edges 62 and 64, and edge 66. Engaging wall 60 also comprises stitching 70 adjacent to edge 66. Attachment point 74 is located at a predetermined distance from edge 66. In addition, engaging wall 60 comprises expandable section 76, and may comprise window 72 that is transparent. Cord 90 may extend from attachment point 74 and may be secured to grommet 48, seen in FIG. 3, with end 92 as seen in FIG. 1, in an effort to keep instant invention 10 better mounted onto chair assembly 100, and specifically backrest 108. Instant invention 10 may further comprise matrix barcode 78.

As seen in FIG. 3, present invention 10 is a stadium-styled universal seat cover that converts to a backpack or tote, whereby front wall 20 and rear wall 40 have a similar shape and dimension in a preferred embodiment. Rear wall 40 extends from edge 26 and comprises lateral edges 42 and 44, and edge 46. Rear wall 40 also comprises stitching 50 adjacent to edge 46. In addition, rear wall 40 comprises open channels 56 and 58. It is noted that rear wall 40 also comprises a window like front wall 20, which is transparent, so that the seat number is visible.

In a preferred embodiment, cord assembly 80 comprises two cords, each having ends 82 and 84. In a preferred embodiment, ends 82 are secured at a first grommet 34. The cords enter through channels 36 and 56 respectively, exit channels 38 and 58 respectively, and ends 84 are secured at the second grommet 34. It is noted that cord assembly 80 is secured between edge 28 and stitching 30 at front wall 20 as seen in FIG. 1, and between edge 46 and stitching 50 at rear wall 40.

Figure 4:
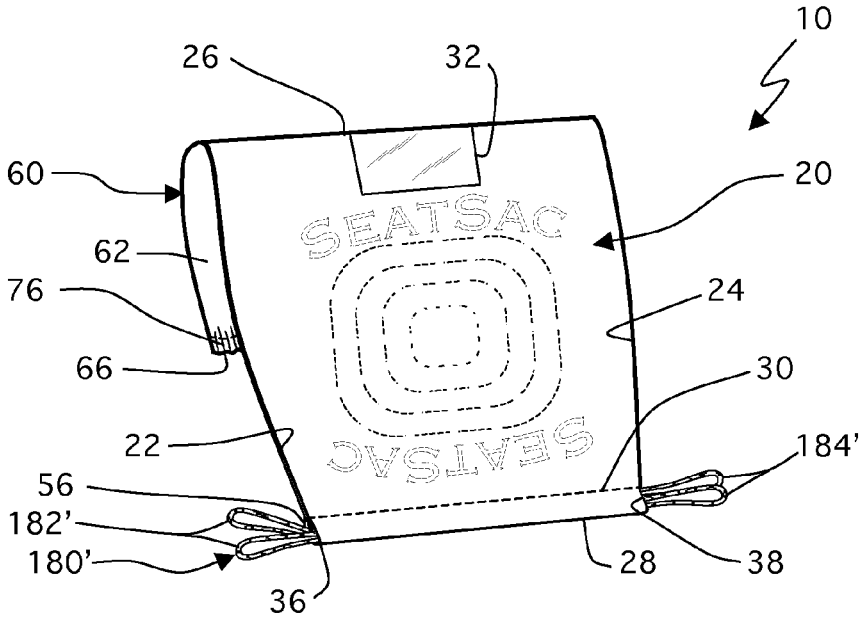
FIG. 4 is a front isometric view of an alternate embodiment of the convertible seat cover in a seat cover configuration.
Figure 5:
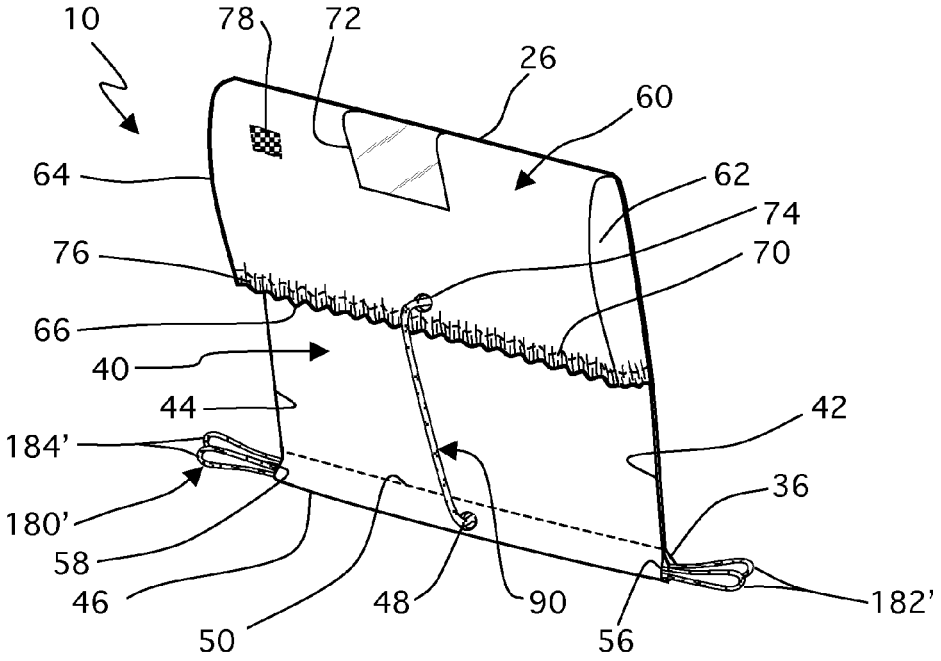
FIG. 5 is a rear isometric view of the alternate embodiment of the convertible seat cover in a seat cover configuration seen in FIG. 4.
Figure 6:
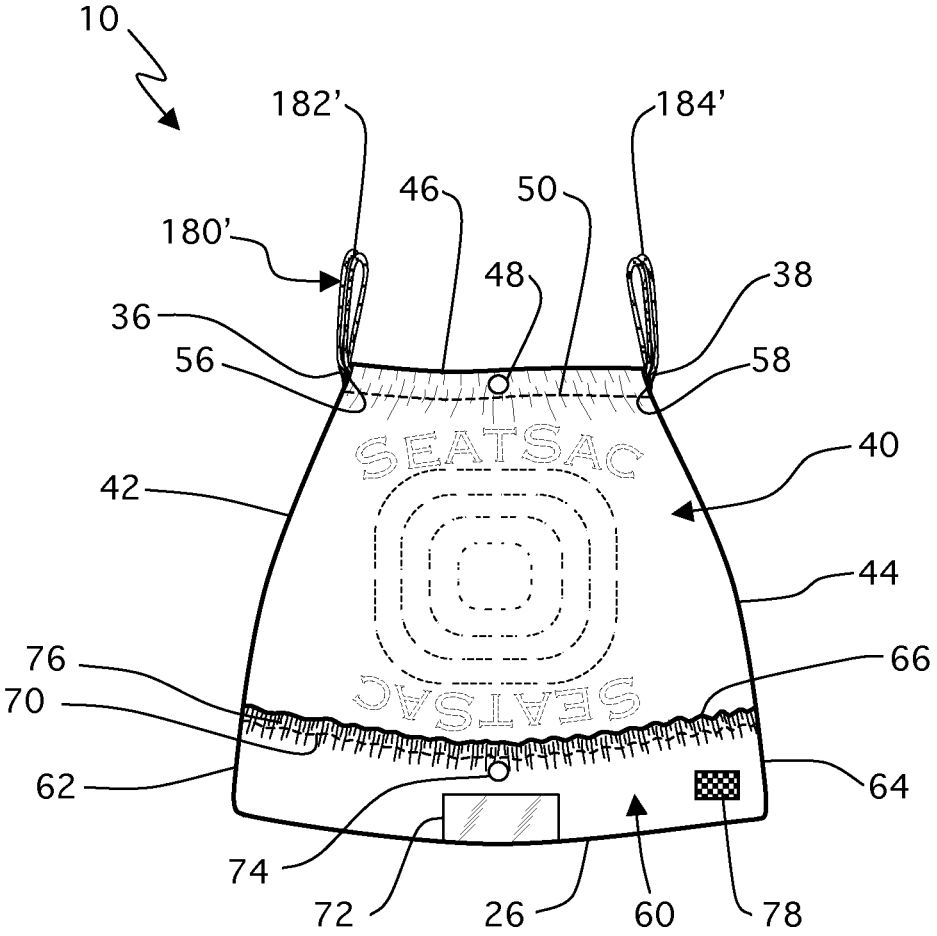
FIG. 6 is a front elevational view of the alternate embodiment of the convertible seat cover in a tote configuration.

Seen in FIGS. 4, 5, and 6 is an alternate embodiment of instant invention 10.

As seen in FIG. 4, front wall 20 comprises lateral edges 22 and 24, and edges 26 and 28. Front wall 20 also comprises stitching 30 adjacent to edge 28. In addition, front wall 20 comprises open channels 36 and 38. Front wall 20 comprises window 32, which is transparent, so that a seat number is visible. It is noted that rear wall 40 also comprises a window like front wall 20, which is transparent, so that the seat number is visible.

As seen in FIG. 5, engaging wall 60 extends from edge 26 a predetermined distance towards edge 46. Engaging wall 60 comprises lateral edges 62 and 64, and edge 66. Engaging wall 60 also comprises stitching 70 adjacent to edge 66. Attachment point 74 is located at a predetermined distance from edge 66. In addition, engaging wall 60 comprises expandable section 76, and may comprise window 72 that is transparent. Cord 90 may extend from attachment point 74 and may be secured to grommet 48 in an effort to keep instant invention 10 better mounted onto chair assembly 100, and specifically backrest 108 seen in FIGS. 1 and 2. Instant invention 10 may further comprise matrix barcode 78.

As seen in FIG. 6, present invention 10 is a stadium-styled universal seat cover that converts to a backpack or tote, whereby front wall 20 and rear wall 40 have a similar shape and dimension in a preferred embodiment. Rear wall 40 extends from edge 26 and comprises lateral edges 42 and 44, and edge 46. Rear wall 40 also comprises stitching 50 adjacent to edge 46. In addition, rear wall 40 comprises open channels 56 and 58.

In a preferred embodiment, cord 180' comprises two cords, each having ends 182' and 184' that extend from channels 36 and 38, seen in FIG. 4, and 56 and 58 respectively. It is noted that cord 180' is secured between edge 28 and stitching 30 at front wall 20 as seen in FIG. 4, and between edge 46 and stitching 50 at rear wall 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A convertible seat cover comprising:

A) a front wall comprising first and second lateral edges, and first and second edges, said front wall also comprises first stitching adjacent to said first edge, said front wall further comprises first and second openings to a first channel;

B) a rear wall that extends from said second edge, said rear wall comprises third and fourth lateral edges, and a third edge, said rear wall further comprises second stitching adjacent to said third edge;

C) an engaging wall that extends from said second edge, said engaging wall comprises fifth and sixth lateral edges, and a fourth edge, said engaging wall further comprises third stitching adjacent to said fourth edge, said rear wall extending from said second edge and said engaging wall including said fifth and sixth lateral edges define a cavity having a rectangular opening for receiving said backrest of said seat assembly; and D) a cord assembly.

2. The convertible seat cover set forth in claim 1, further characterized in that said engaging wall comprises an attachment point located at a predetermined distance from said fourth edge.

3. The convertible seat cover set forth in claim 2, further characterized in that said rear wall comprises a first grommet.

4. The convertible seat cover set forth in claim 3, further comprising a cord that extends from said attachment point to said grommet.

5. The convertible seat cover set forth in claim 1, further characterized in that said engaging wall comprises an expandable section, said rear wall extending from said second edge and said engaging wall including said fifth and sixth lateral edges further define a rectangular configuration as an opening of said cavity for receiving said backrest of said seat assembly.

6. The convertible seat cover set forth in claim 1, further characterized in that said front and rear walls and/or said engaging wall comprises a window that is transparent.

7. The convertible seat cover set forth in claim 1, further comprising a matrix barcode.

8. The convertible seat cover set forth in claim 1, further characterized in that said first channel extends between said first edge and said first stitching.

9. The convertible seat cover set forth in claim 1, further characterized in that said front wall and said rear wall have a similar shape and dimension.

10. The convertible seat cover set forth in claim 1, further characterized in that said engaging wall extends from said second edge a predetermined distance towards said third edge.

11. The convertible seat cover set forth in claim 1, further characterized in that said rear wall further comprises third and fourth openings to a second channel.

12. The convertible seat cover set forth in claim 11, further characterized in that said second channel extends between said third edge and said second stitching.

13. The convertible seat cover set forth in claim 12, further comprising second and third grommets located at a predetermined distance from said second edge.

14. The convertible seat cover set forth in claim 13, further characterized in that said cord assembly comprises two cords.

15. The convertible seat cover set forth in claim 14, further characterized in that said two cords each have first and second ends.

16. The convertible seat cover set forth in claim 15, further characterized in that said first ends are secured to said second grommet.

17. The convertible seat cover set forth in claim 16, further characterized in that said second ends enter through said first and third openings.

18. The convertible seat cover set forth in claim 17, further characterized in that said second ends exit through said second and fourth openings.

19. The convertible seat cover set forth in claim 18, further characterized in that said second ends are secured at said third grommet.

20. The convertible seat cover set forth in claim 19, further characterized in that said cord assembly is secured between said first edge and said first stitching at said front wall, and between said third edge and said second stitching at said rear wall.

* * * * *